US006854371B2

(12) United States Patent
Yu

(10) Patent No.: US 6,854,371 B2
(45) Date of Patent: Feb. 15, 2005

(54) DEVICE FOR SMOOTH SLIDING OF A POSITIONING ROD OF A SAWING DEVICE PLATFORM

(76) Inventor: Shi-Whi Yu, PMB#1008, 1867 Yqnacio Valley Rd., Walnut Creek, CA (US) 94598-3214

( * ) Notice: Subject to any disclaimer, the term of this patent is extended or adjusted under 35 U.S.C. 154(b) by 31 days.

(21) Appl. No.: 10/314,302

(22) Filed: Dec. 9, 2002

(65) Prior Publication Data

US 2004/0107812 A1 Jun. 10, 2004

(51) Int. Cl.[7] ..... B26D 7/06

(52) U.S. Cl. ..... 83/438; 83/477.2; 83/522.19; 83/468.7

(58) Field of Search ..... 83/477.2, 438, 83/522, 468.7, 467.1, 522.19, 446; 144/286.1, 253.1; 269/318, 236, 285, 303, 315

(56) References Cited

U.S. PATENT DOCUMENTS 2,075,282 A * 3/1937 Hedgpeth ..... 83/438
3,011,531 A * 12/1961 Gaskell ..... 83/438
4,206,910 A * 6/1980 Biesemeyer ..... 269/236
5,181,446 A * 1/1993 Theising ..... 83/438
5,293,802 A * 3/1994 Shiotani et al. ..... 83/468.7
6,575,067 B2 * 6/2003 Parks et al. ..... 83/435.27
6,647,847 B2 * 11/2003 Hewitt et al. ..... 83/446
2002/0088325 A1 * 7/2002 Talesky et al. ..... 83/438
2003/0097921 A1 * 5/2003 Wilke et al. ..... 83/477.2

* cited by examiner

*Primary Examiner*—Boyer D. Ashley
(74) *Attorney, Agent, or Firm*—Leong C. Lei

(57) ABSTRACT

A device for smooth sliding of a positioning rod of a sawing device platform is disclosed. The device includes a support platform or a lateral side of an auxiliary platform with a calibration rod and a gap is formed between the calibration rod. A support platform or the lateral side of the auxiliary platform. The support platform or the auxiliary platform is flatly mounted with the positioning rod which slides between the support platform and the auxiliary platform. A bottom face of one end of the positioning rod, closer to an operator is provided with an inverted L-shaped corner plate perpendicular to the positioning rod, the end face at the same end of the positioning rod is provided with two parallel wing plates having a distance apart, the top section between the two wing plates is pivotally mounted with a swing plate, whereby when the eccentric wheel and the calibration are urged with each other, the screw nuts of the two auxiliary plates dislocate the urging of the calibration rod thereby enabling the positioning rod to be smoothly moved without forming an eccentric movement.

3 Claims, 9 Drawing Sheets

DEVICE FOR SMOOTH SLIDING OF A POSITIONING ROD OF A SAWING DEVICE PLATFORM

BACKGROUND OF THE INVENTION (a) Technical Field of the Invention

The present invention relates to sawing device platform, and in particular, a device for smooth sliding of a positioning rod of a sawing device platform.

(b) Description of the Prior Art

It has been found that the positioning rod of the conventional sawing device platform cannot be moved smoothly along a straight line thereby causing much inconvenience in use.

Therefore, it is an object of the present invention to provide a sawing device platform for smooth sliding of a positioning rod of a sawing device platform.

SUMMARY OF THE INVENTION

It is an object of the present invention is to provide a device for smooth sliding of a positioning rod of a sawing device platform, wherein the support platform or the lateral side of the auxiliary platform is provided with a calibration rod and a gap is formed between the calibration rod and the support platform or the lateral side of the auxiliary platform the support platform or the auxiliary platform is flatly mounted with a positioning rod which can slide between the support platform and the auxiliary platform, the bottom face of one end of the positioning rod, closer to an operator is provided with an inverted L-shaped corner plate perpendicular to the positioning rod, the end face at the same end of the positioning rod is provided with two parallel wing plates having a distance apart, the top section between the two wing plates is pivotally mounted with a swing plate, the swing plate corresponding to the inner side of the end face of the positioning rod is urged by a spring connected to the positioning rod and the swing plate is urged by the spring to swing eccentrically outward, the lower section between the two wing plates is pivotally mounted with a control rod having mounted with an eccentric wheel, the other end of the control rod is provided with a handle and the eccentric wheel and the lower end of the swing plate are urged together, the external lateral face of the two wing plate is provided with an auxiliary plate having screw hole allowing the insertion of screws, the vertical lateral plate of the corner plate is inserted into the gap, a metal plate is welded to the lateral edge of the vertical plate of the corner plate corresponding to the calibration rod, and the welding point of the metal plate is located at the middle position thereof, the two ends of the metal plate is provided with a frictional plate, and the two wing plates of the positioning rod are located at the other side of the calibration rod of the two auxiliary plates, and when the two lateral sides of the calibration rods at the eccentric wheel of the control rod are dislocated, the frictional plates and the screw nuts of the two auxiliary plates urge slightly the calibration rod, and when the eccentric wheel and the calibration are urged with each other, the screw nuts of the two auxiliary plates dislocate the urging of the calibration rod.

Yet a further object of the present invention is to provide a device for smooth sliding of a positioning rod of a sawing device platform, wherein the lateral side of the swing plate corresponding to the end face of the positioning rod is provided with a sunken hole having mounted with a spring, and the inner hole of the spring is inserted by a screw bolt to lock at the lower section of the end face of the positioning rod.

A further object of the present invention is to provide a device for smooth sliding of a positioning rod of a sawing device platform, wherein the frictional plate of the bottom face of the positioning rod, and the frictional plate of the metal plate, the screws on the horizontal side plate of the corner plate and the screw of the two auxiliary plates are made from plastic material.

Other objects, and advantages of the present invention can be more fully understood by reading the following detailed description of the preferred embodiment, with reference to the accompanying.

DETAILED DESCRIPTION OF THE PREFERRED EMBODIMENT

Figure 1:
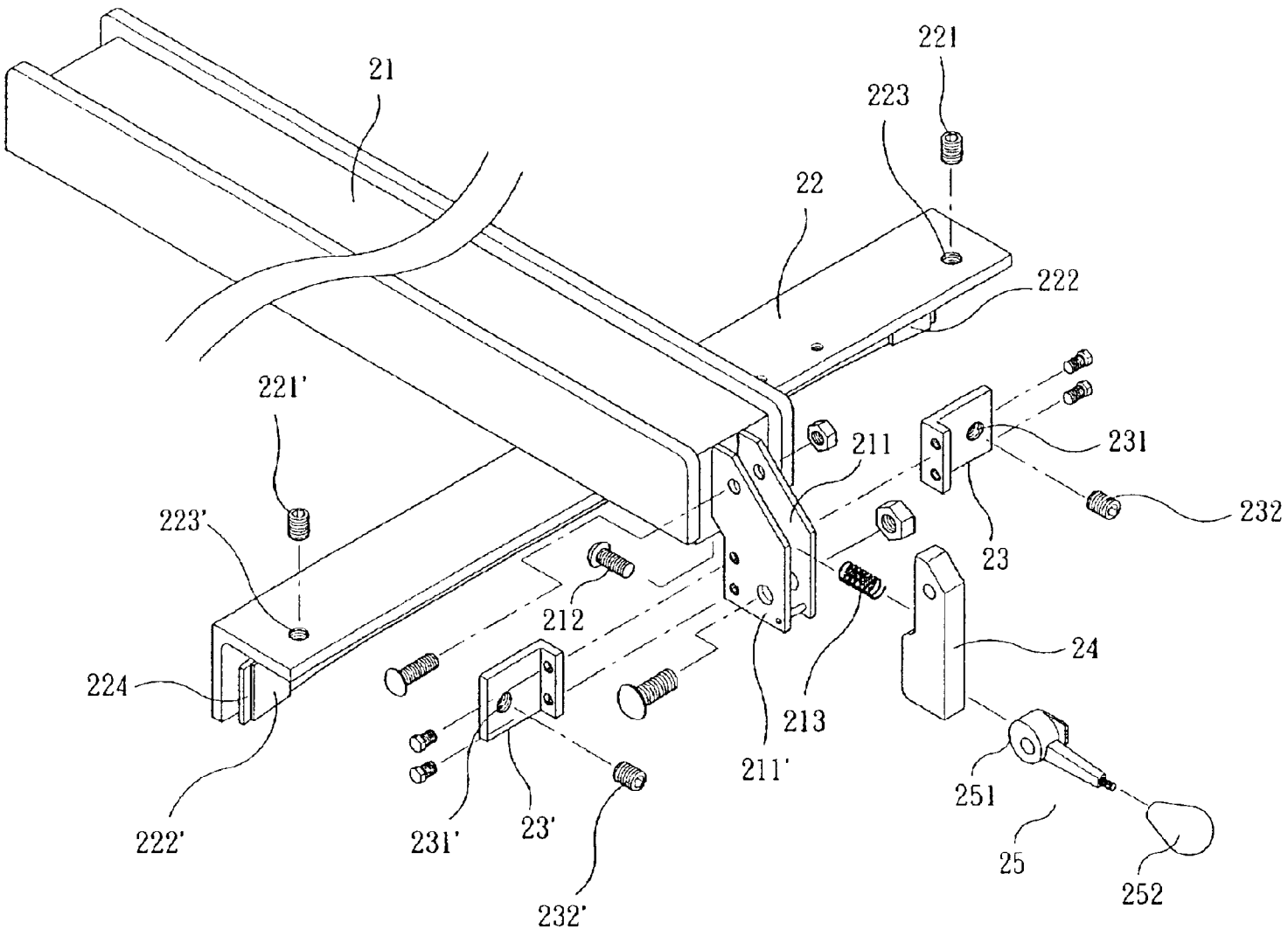
FIG. 1 is a perspective exploded view of the present invention.
Figure 2:
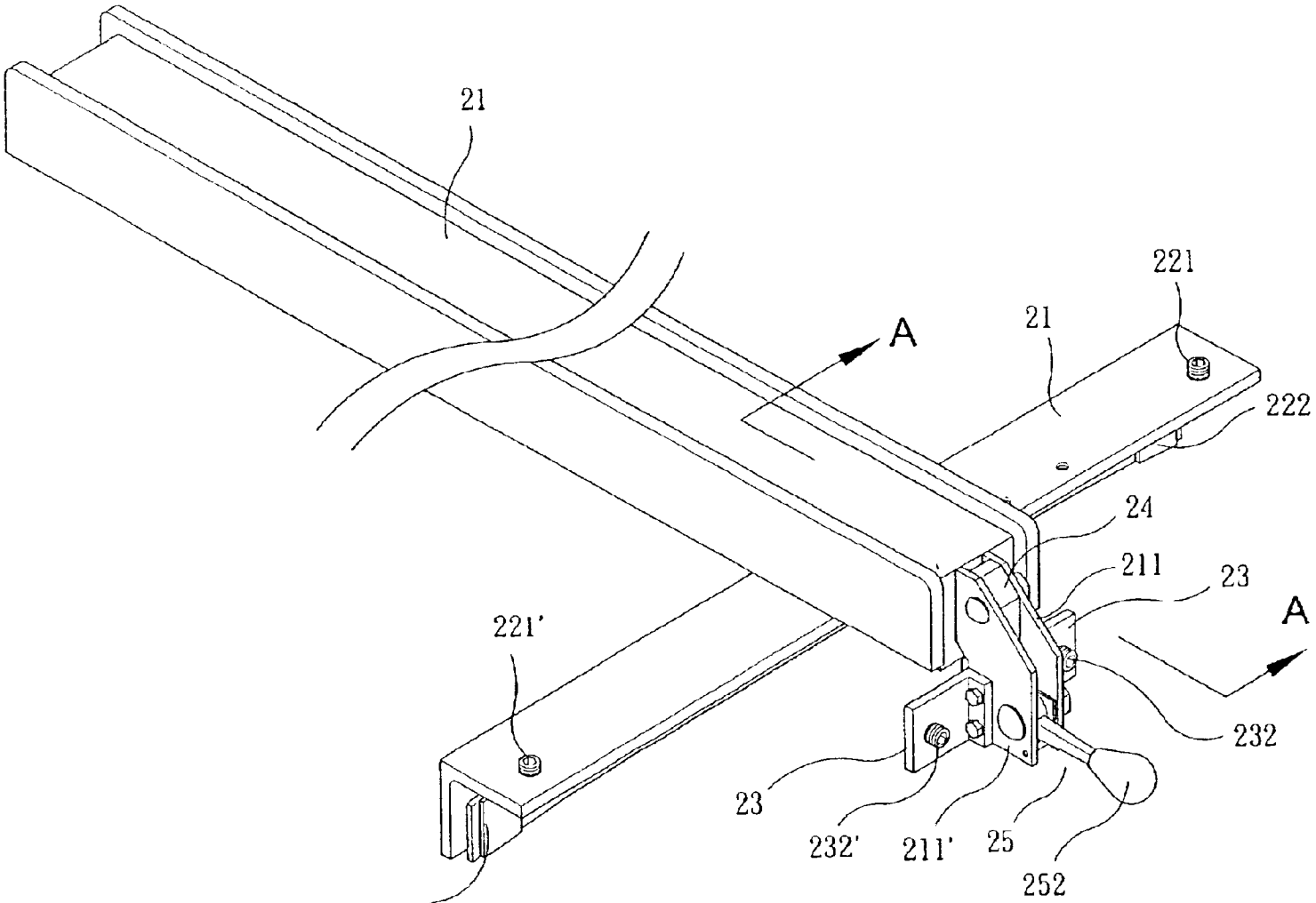
FIG. 2 is a perspective view of the present invention.
Figure 3:
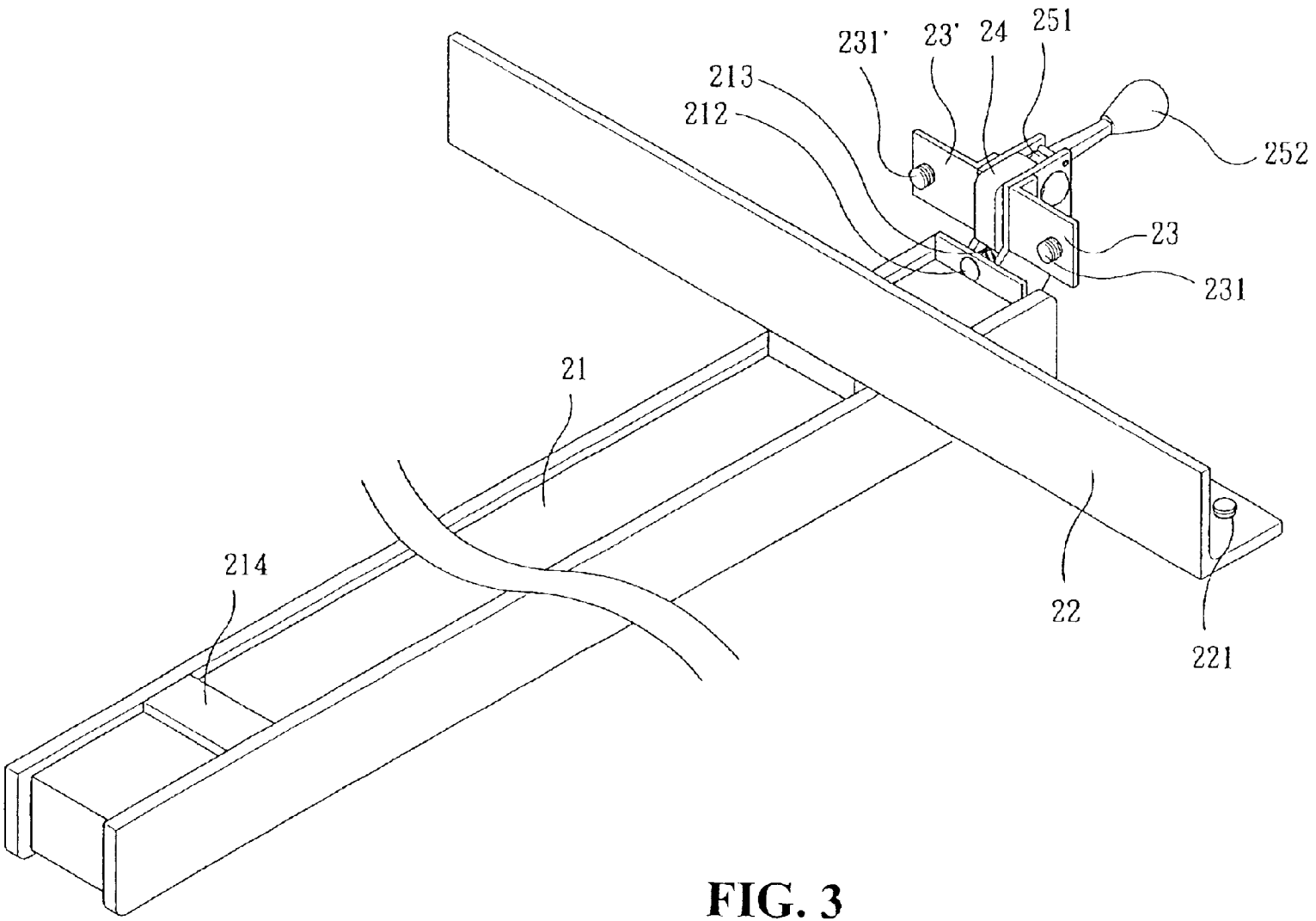
FIG. 3 is a perspective view of the rear view of the present invention.
Figure 4A:
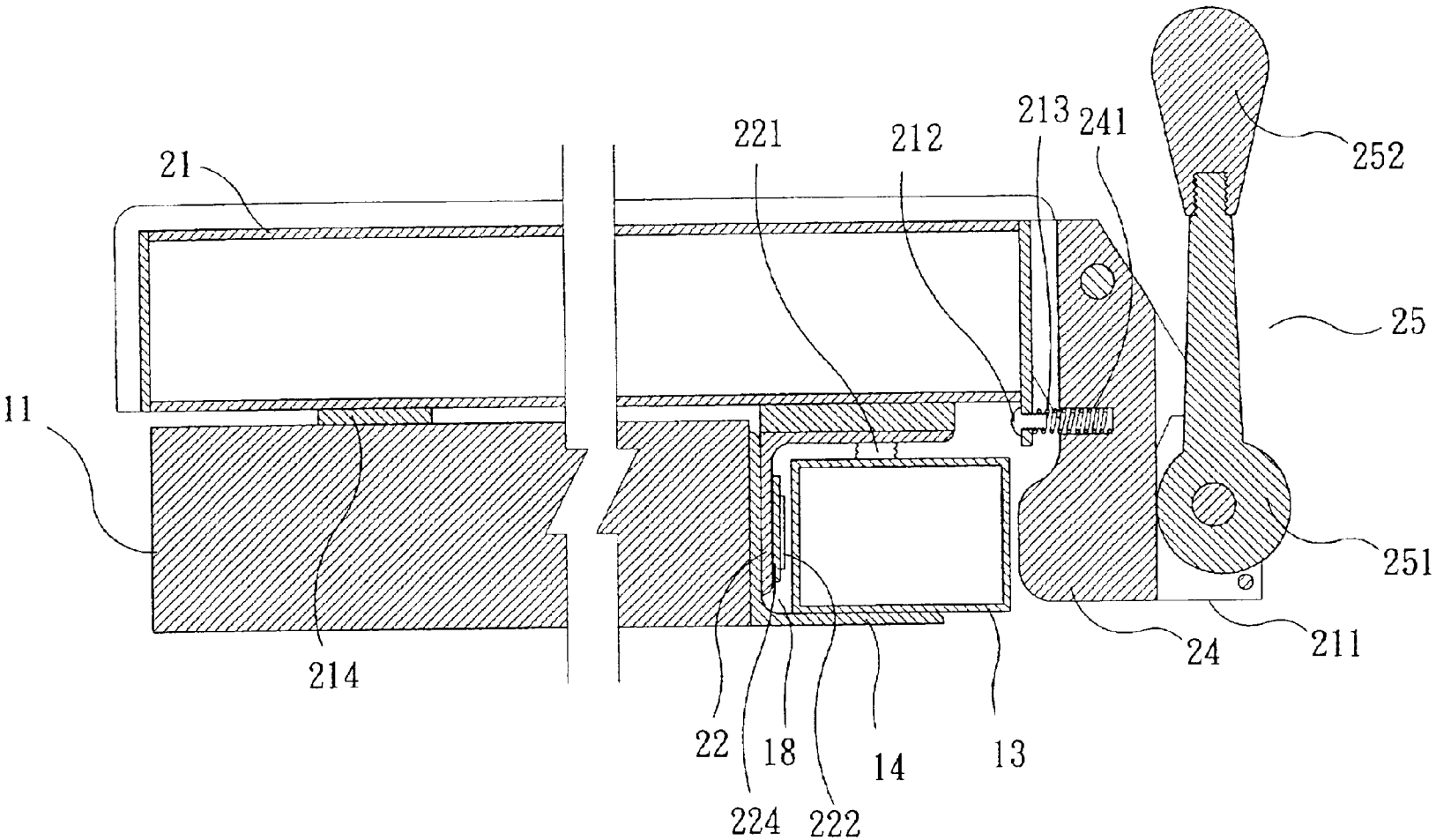
FIG. 4A is a sectional view of the positioning rod in an urging state in accordance with the present invention.
Figure 4B:
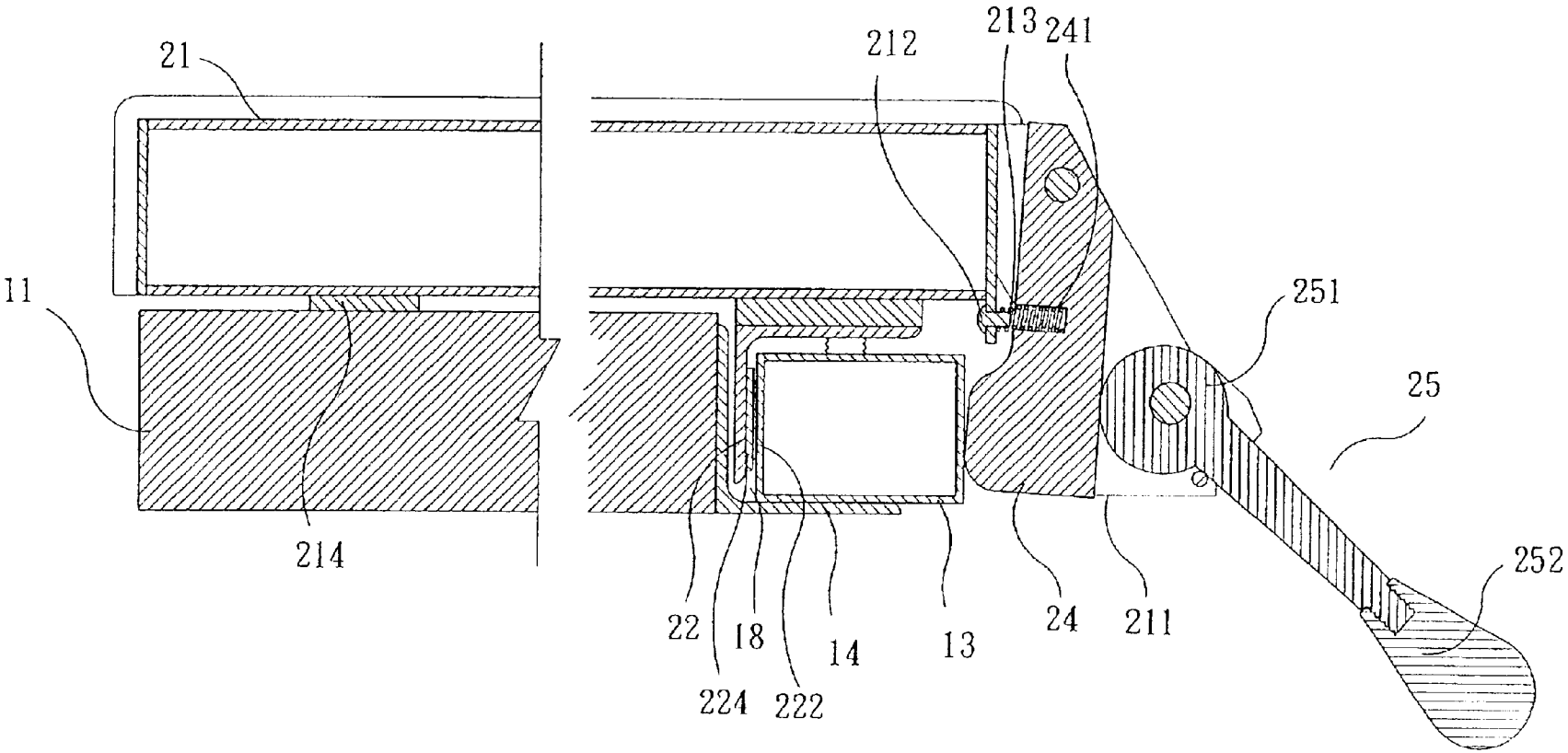
FIG. 4B is a sectional view of the positioning rod in a dislocation state in accordance with the present invention.
Figure 5A:
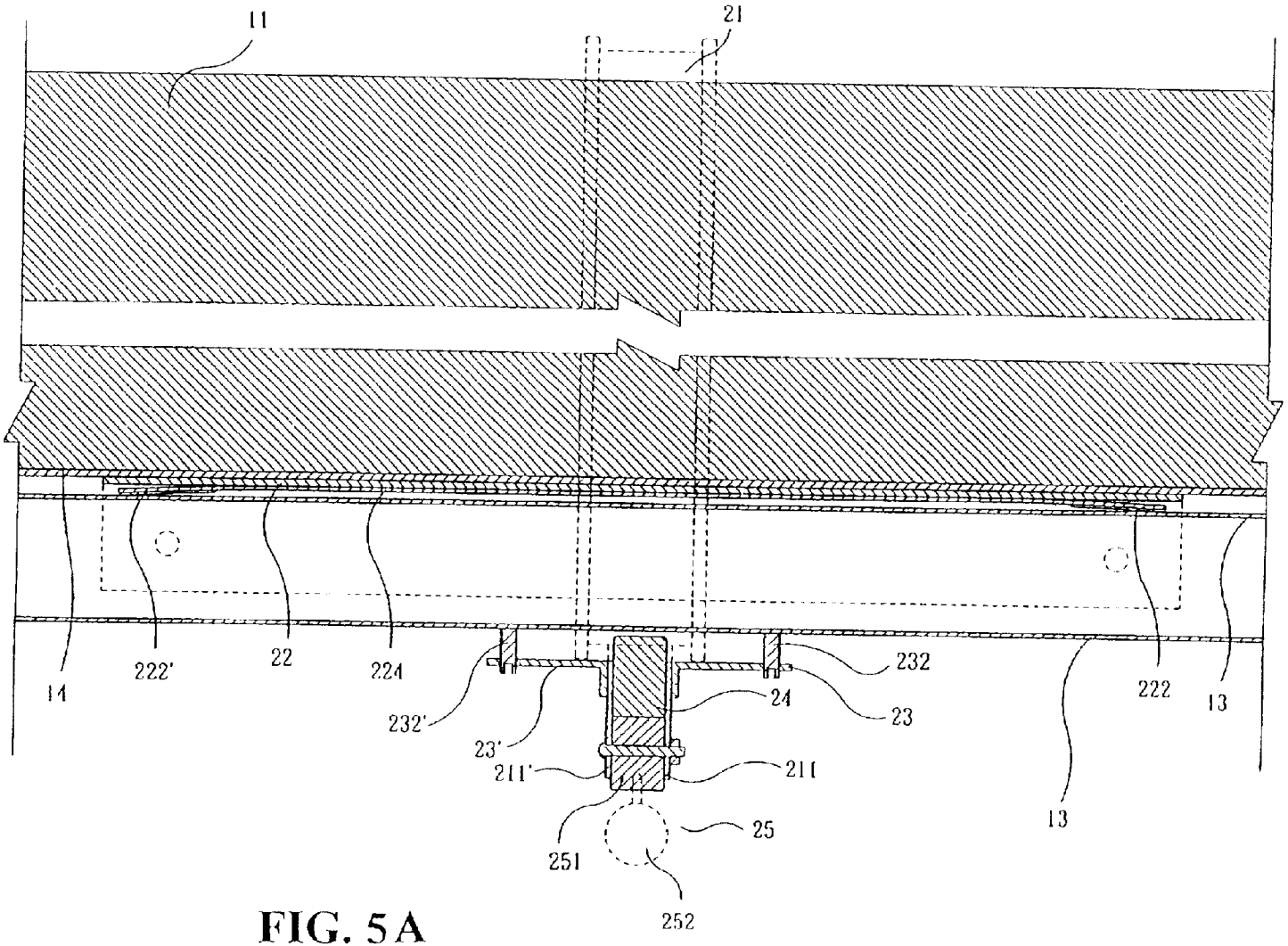
FIG. 5A is another sectional view of the positioning rod in an urging state in accordance with the present invention.
Figure 5B:
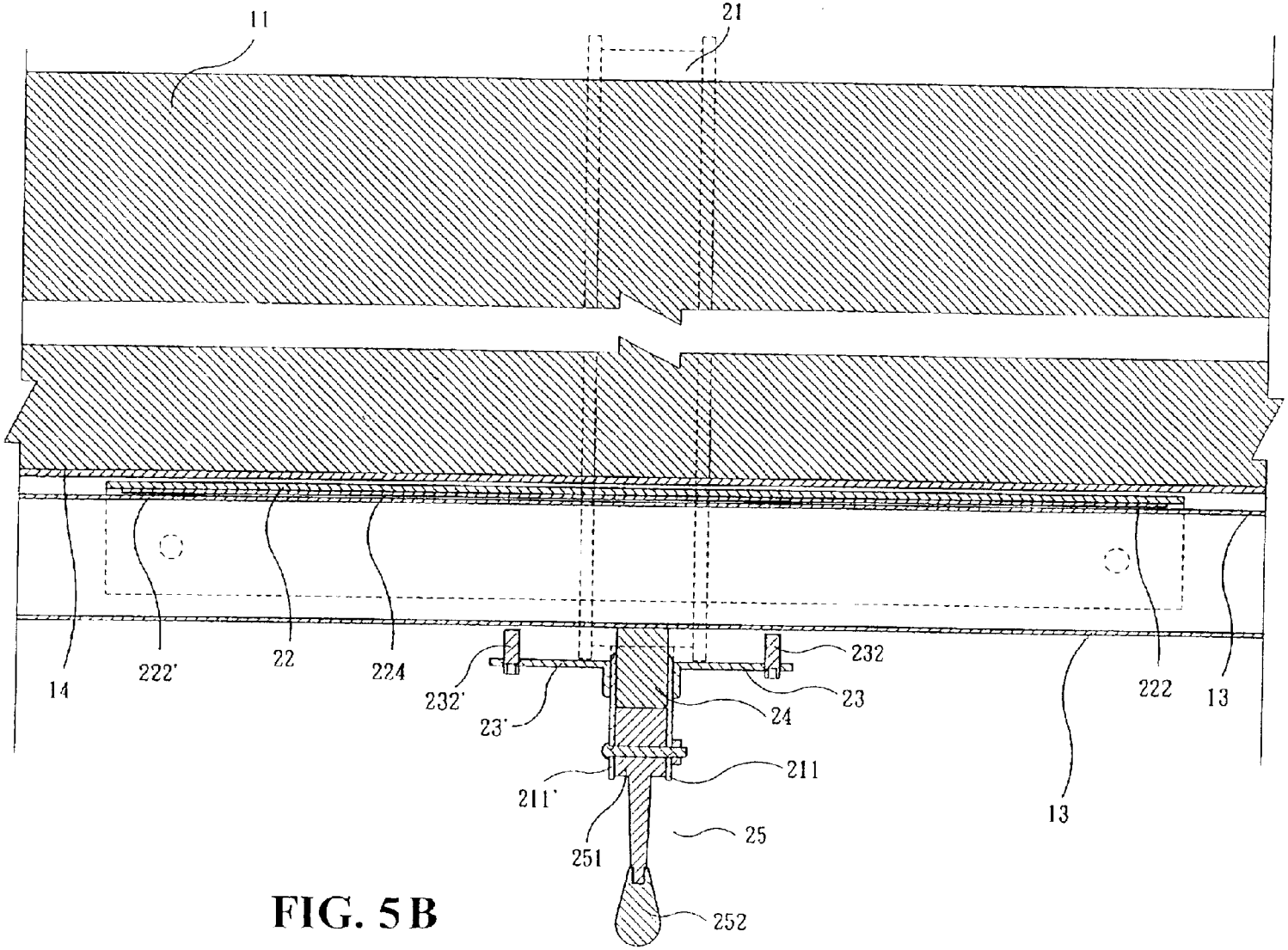
FIG. 5B is another sectional view of the positioning rod in a dislocation state in accordance with the present invention.
Figure 6:
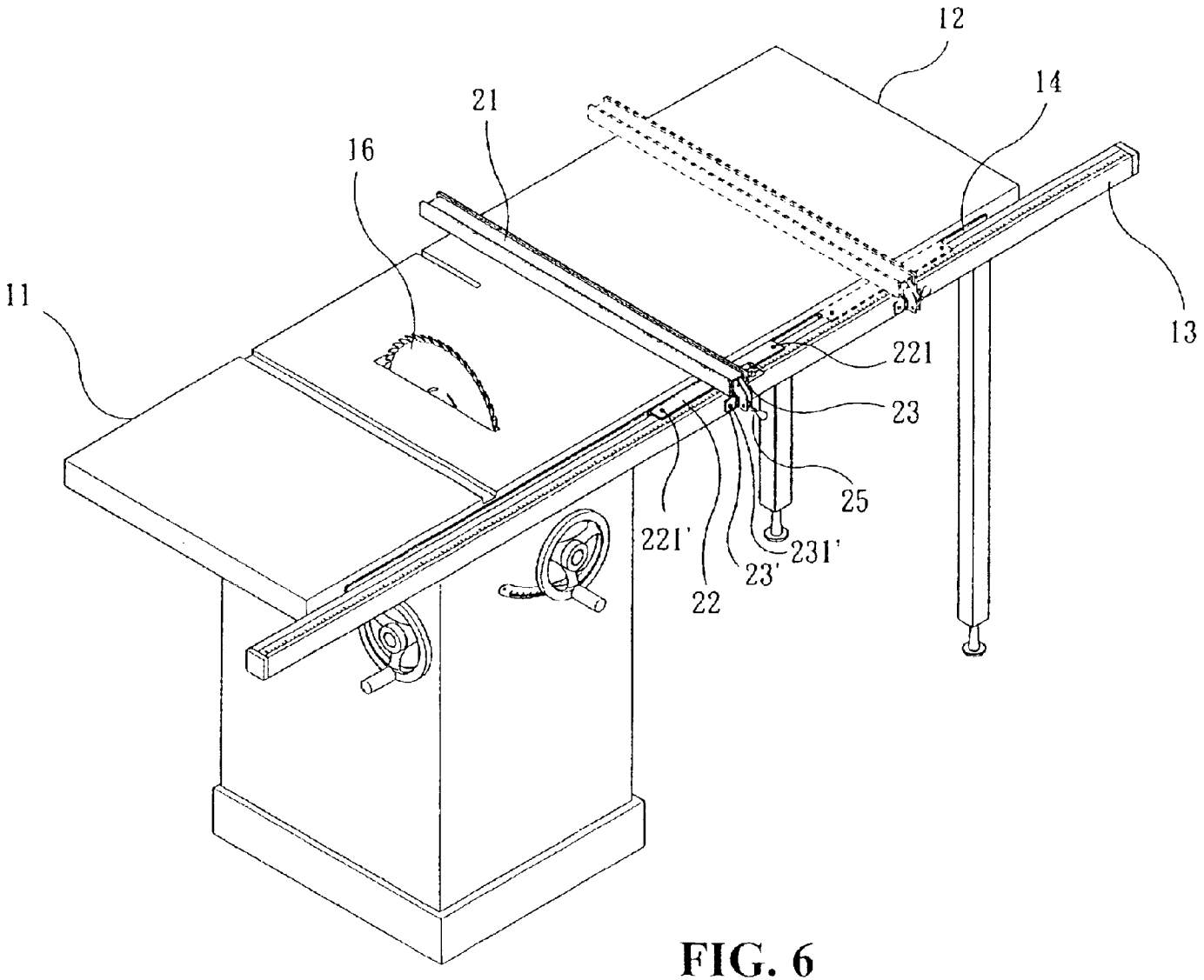
FIG. 6 is a schematic view showing the sliding of the positioning rod in accordance with the present invention.
Figure 7:
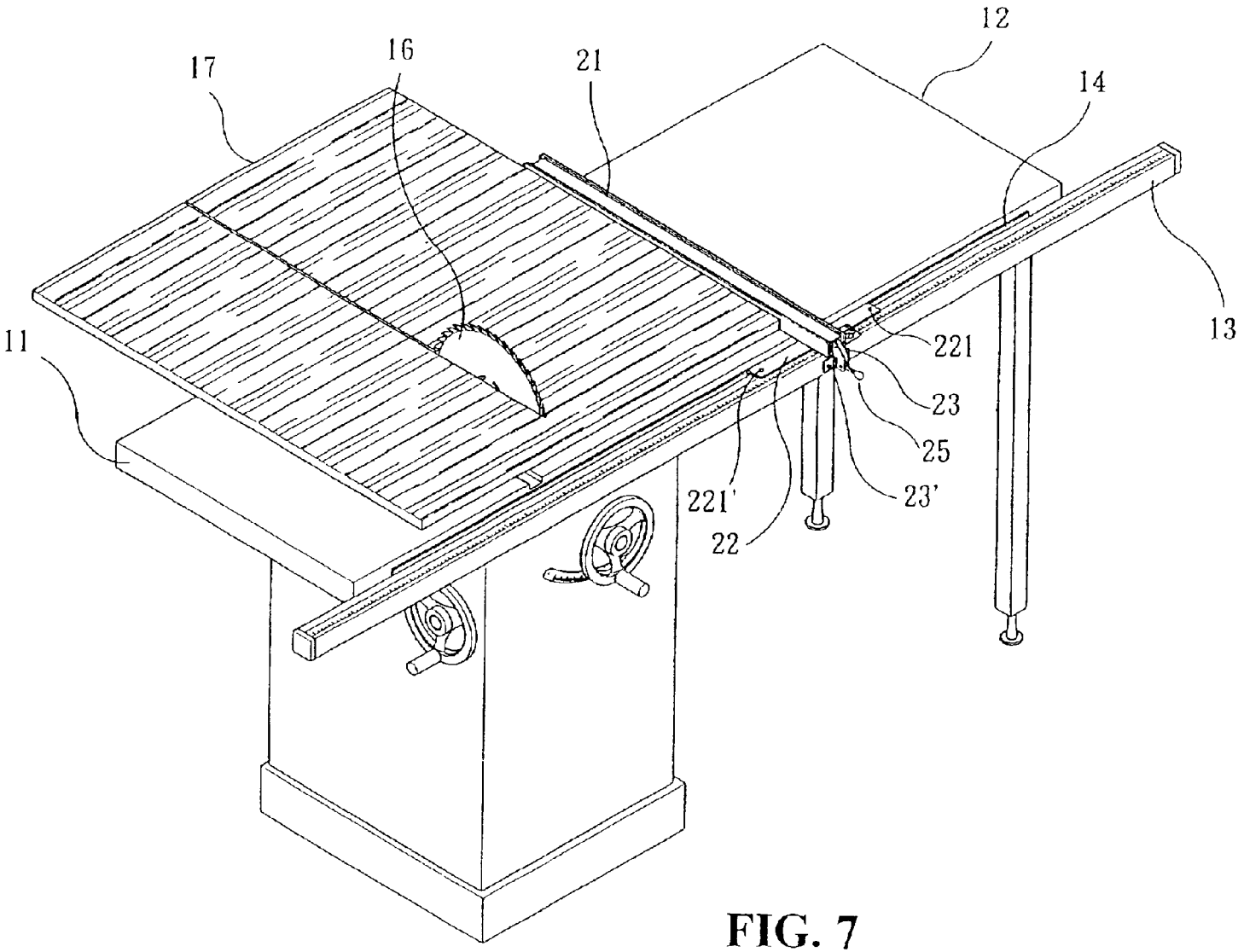
FIG. 7 is a schematic view showing the application of the present invention.

Referring to FIG. 1, there is shown a positioning rod 21 in accordance with the present invention. The rod 21 is an elongated tubular body and the sides thereof are provided with a resilient plastic board. One end of the bottom face thereof is provided with a plastic frictional plate 214, and the other end of the positioning end (close to the operator end) is provided with a corner board 22 perpendicular to the positioning rod 21. The corner board 22 is mounted to the bottom face of the positioning rod 21 with its horizontal side board, and the two ends of the side board are provided with screw holes 223, 223'. The screw holes 223, 223' are used for the insertion of plastic screws 221, 221'. The vertical lateral board of the corner board 22 and the lateral side corresponding to a calibration rod 13 is welded to an elongated metal plate 224. The welding point is located at the middle position, and the two ends of the metal plate 224 are bent upward. The two closer ends of the metal plate 224 are provided with a frictional plate 222, 222' respectively. The end face of the positioning rod 21 is provided with two wing boards 211, 211'. In between the top and the bottom section of the two wing boards 211, 211', a swinging board 24 and a control rod 25 are provided. The swinging board 24 corresponding to the inner lateral face of the end face of the positioning rod, a sunken hole 241 is provided. This sunken hole 241 is for the insertion of a spring 213, and the inner hole of the spring 213 is for the insertion of a screw bolt 212, locked at the end face of the positioning rod 21, such that the swinging board 24, urging by the spring 213, resists to swing externally. The pivotal end of the control rod 25 is an eccentric wheel 251 and the other end of the control rod 25 is provided with a handle 252. The lower section of the swinging board 24 is constantly urging to the ring face of the eccentric wheel 251. The external face of the two wing plates 211, 211' are respectively provided with an auxiliary plate 23, 23'. The two auxiliary plates 23, 23' which correspond to the lateral side of the corner board are provided with screw holes 231, 231' which are used for the positioning of plastic screws 232, 232'. FIGS. 5 and 6 show the configuration of the device in accordance with the present invention.

Referring to FIGS. 2 to 7, the positioning rod 21 is flatly positioned onto the platform board 11 or the auxiliary platform board 12 of the sawing device. The positioning rod 21 is mounted onto a vertical lateral board of the corner board fixed to a L-shaped fixing plate 14 and the gap 18 between the platform board 11 and the auxiliary platform 12. The corner board 22 and the two wing boards 211, 211' are positioned at the swing plate 24 and the control rod 25. The auxiliary plates 23, 23' are located at the two lateral sides of the calibration rod 13. The positioning rod 21 is slidable within the gap 18 under the help of the corner plate 22. The positioning rod 21 can be controlled by the operator of the device so that the control rod 25 can be pressed clockwise, and the larger ring face of the eccentric wheel 25 urges the swing plate to swing internally. Due to the fact that the calibration rod 13 is fixed to the fixing plate 14 and is not moveable, the corner plate 22 is pulled toward the side of the calibration rod 13 and rotates to the maximum ring face according to the eccentric wheel 251, and urges the external face of the calibration rod 13. The bent ends of the metal plate 224 are pressed flatly and the two lateral sides of the calibration are clipped by the two frictional plates 222, 222' and the eccentric wheel 251 such that the positioning rod 21 is not moveable. The screws 232, 232' of two auxiliary plates 23, 23' are dislocated from the urging by the calibration rod 13 such that the positioning rod 21 can provide a support for a wooden board so that sawing process will not cause a movement and to ensure the board upon sawing is complied with requirement. If the positioning rod 21 is to be moved to another calibration position, the control rod 25 is rotated counter clockwise and the handle 252 is rotated upward such that the larger ring face of the eccentric wheel 251 is dislocated from the urging of the swing plate 24. The two frictional plate 222, 222' and the calibration rod 13 become a dislocation state. The two ends of the metal plates 224 are restored to the bent upward configuration and the frictional plates 222, 222' are slightly urged the lateral side of the calibration rod 13. When the two ends of the metal plate 224 restored to the bent configuration, the two wing plates 221,221' the swing plate 24, the control rod 25 are fixed to the two auxiliary plates 23, 23' pulled toward the lateral side of the calibration rod 13 such that the screws 232, 232' of the auxiliary plate 23, 23' slightly urge the side of the calibration rod 13. The smallest ring face of the eccentric wheel 251 does not urge against the lateral side of the calibration rod 13. The two lateral side of the calibration rod 13 are slightly hold (not urged) by the two screws 232, 232'. Thus, the operator can smoothly move the positioning rod 21 without causing a swinging movement.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A device for smooth sliding of a positioning rod of a sawing device platform, characterized in that the support platform or the lateral side of the auxiliary platform is provided with a calibration rod and a gap is formed between the calibration rod and the support platform or the lateral side of the auxiliary platform, the support platform or the auxiliary platform is flatly mounted with the positioning rod which can slide between the support platform and the auxiliary platform, a bottom face of one end of the positioning rod, closer to an operator is provided with an inverted L-shaped corner plate perpendicular to the positioning rod, an end face at the same end of the positioning rod is provided with two parallel wing plates having a distance apart, the bottom face of the positioning rod on the other end is provided with a frictional plate, a top section between the two parallel wing plates is pivotally mounted with a swing plate, the swing plate corresponding to an inner side of the end face of the positioning rod and is urged by a spring connected to the positioning rod, the swing plate is urged by the spring to swing eccentrically outward, a lower section between the two parallel wing plates are pivotally mounted with a control rod, the control rod is mounted with an eccentric wheel, the other end of the control rod is provided with a handle and the eccentric wheel and a lower end of the swing plates are urged together, an external lateral face of the two parallel wing plates are provided with an auxiliary plate having screw holes allowing for insertion of screws, a vertical lateral side of the inverted L-shaped corner plate is inserted into the gap, a horizontal side of the inverted L-shaped corner plate is provided with holes allowing for insertion of screws, a metal plate is welded to the lateral edge of the vertical lateral plate of the corner side corresponding, to a lateral side of the calibration rod and a welding point of the metal plate is located at a middle position thereof, two ends of the metal plate are provided with frictional plates, and the two parallel wing plates of the positioning rod are located on the other lateral side of the calibration rod adjacent to the auxiliary plates, and when the two lateral sides of the calibration rod at the eccentric wheel of the control rod are dislocated, the frictional plate and the screws of the auxiliary plate urge slightly the calibration rod, and when the eccentric wheel and the calibration rod are urged with each other, the screws of the auxiliary plate dislocate urging of the calibration rod.

2. The device of claim 1, wherein the frictional plate of the bottom face of the positioning rod, the frictional plates of the metal plate, the screws on the horizontal side of the corner plate and the screws of the auxiliary plate are made from plastic material.

3. The device of claim 1, wherein a lateral side of the swing plate corresponding to the end face of the positioning rod is provided with a sunken hole at a lower section of the end face of the positioning rod, the spring is inserted into the sunken hole, wherein a screw is inserted into an inner hole of the spring to hold the spring in place.

* * * * *